US007996935B1

(12) United States Patent
Chen

(10) Patent No.: US 7,996,935 B1
(45) Date of Patent: Aug. 16, 2011

(54) CREDIBLE AND LIGHT FOLDABLE HANGING BED

(76) Inventor: Libin Chen, Changzhou (CN)

( * ) Notice: Subject to any disclaimer, the term of this patent is extended or adjusted under 35 U.S.C. 154(b) by 0 days.

(21) Appl. No.: 12/725,488

(22) Filed: Mar. 17, 2010

(51) Int. Cl.
*A45F 3/24* (2006.01)

(52) U.S. Cl. ..... 5/127; 5/122; 5/120; 5/128

(58) Field of Classification Search ..... 5/120–129, 5/114–116
See application file for complete search history.

(56) References Cited

U.S. PATENT DOCUMENTS

| | | | | | |
|---|---|---|---|---|---|
| 2,581,623 | A * | 1/1952 | Benjamin | ..... | 5/129 |
| 4,691,394 | A * | 9/1987 | Woo | ..... | 5/120 |
| 4,977,631 | A * | 12/1990 | Bretz | ..... | 5/127 |
| 5,113,537 | A * | 5/1992 | Turk | ..... | 5/121 |
| 5,392,476 | A * | 2/1995 | Williams | ..... | 5/127 |
| 6,467,109 | B1 * | 10/2002 | Wu | ..... | 5/120 |
| 6,954,950 | B2 * | 10/2005 | Chen | ..... | 5/122 |
| 7,089,610 | B2 * | 8/2006 | Zhong | ..... | 5/122 |
| 7,395,561 | B2 * | 7/2008 | Le Gette et al. | ..... | 5/127 |
| 7,406,726 | B2 * | 8/2008 | Deng | ..... | 5/127 |
| 7,441,287 | B2 * | 10/2008 | Zheng | ..... | 5/129 |
| 7,571,499 | B2 * | 8/2009 | Le Gette et al. | ..... | 5/127 |
| 2004/0205893 | A1 * | 10/2004 | Chen | ..... | 5/122 |
| 2006/0070180 | A1 * | 4/2006 | Le Gette et al. | ..... | 5/120 |
| 2006/0282948 | A1 * | 12/2006 | Deng | ..... | 5/127 |
| 2007/0017026 | A1 * | 1/2007 | Lam | ..... | 5/127 |
| 2007/0209113 | A1 * | 9/2007 | Le Gette et al. | ..... | 5/127 |
| 2008/0256703 | A1 * | 10/2008 | Le Gette et al. | ..... | 5/129 |
| 2010/0287700 | A1 * | 11/2010 | Reeb et al. | ..... | 5/127 |

* cited by examiner

*Primary Examiner* — Robert G Santos
*Assistant Examiner* — Brittany M Wilson

(57) ABSTRACT

A light and credible foldable hanging bed having a frame and a fabric attached thereto. The frame has seats and successive supporting arms linked thereto. Linking poles are provided to move the supporting arms and sponge sleeves may be used for holding by hands of a user. With the successive first and second supporting arms, the joint and check element are saved and the risk of break of the joint is diminished and a weight will be able to be lowered.

2 Claims, 3 Drawing Sheets

CREDIBLE AND LIGHT FOLDABLE HANGING BED

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention relates to a credible and light foldable hanging bed, and more particularly, to a foldable hanging bed which has a credible anti-break frame, is light in weight, and meanwhile able to be folded and expanded easily all at once.

2. Description of Related Art

A foldable hanging bed was disclosed in a U.S. Pat. No. 6,954,950. The bed has two pillar tubes (4) each of which pivotally connected to a main support tube (9). An iron check element (5) is snap fit to each main support tube (9) and corresponding pillar tube (4) for limiting the pillar tube (4) to inward rotation when force is exerted on the hanging bed during use. A pillar support tube (11) is provided for pulling and preventing a swing of each pillar tube (4).

In order to prevent inward rotation of the pillar tubes (4) when the hanging bed is in use, a great stopping force from the iron checks element (5) must exert on the pillar tubes (4). Thus, the pillar tubes (4) and the iron check elements (5) have to be strong enough, and a strong structure usually means a heavy weight. Furthermore, the two section design, i.e., the pivotally linking pillar tube (4) and the main support tube (9), intrinsically has a risk of break at a joint therebetween. Therefor, a light hanging bed has a credible anti-break capability has long been sought.

BRIEF SUMMARY OF THE INVENTION

The main object of the invention is to provide a light and credible foldable hanging bed without sacrificing the easiness of operation of folding and expanding.

In order to accomplish the above objects, the present invention provides a light and credible foldable hanging bed having a frame and a bed fabric attached to the frame. The frame has a first seat and a second seat; a successive first supporting arm and a successive second supporting arm pivotally linked to the first seat and the second seat, respectively; a first lower linking pole having an upper end and a lower end pivotally linking to the second seat; a second lower linking pole having an upper end and a lower end pivotally linking to the first seat, with the first lower linking pole and the second lower linking pole being cross junctured by a middle pin; a first upper linking pole having two ends pivotally linked to the first supporting arm and the upper end of the first lower linking pole, respectively; a second upper linking pole having two ends pivotally linked to the second supporting arm and the upper end of the second lower linking pole, respectively; a stopping element provided at each point where the first upper linking pole pivotally links to the first lower linking pole or the second upper linking pole pivotally links to the second lower linking pole; a pair of first side support tubes pivoted to the first lower linking pole, respectively; a pair of second side support tubes pivoted to the second lower linking pole, respectively; a shoe provided at a lower end of each side support tube; a first connecting tube pivotally linking one shoe on each first side support tube and the first seat; and, a second connecting tube pivotally linking one shoe on each second side support tube and the second seat.

These and other objectives, features, and advantages of the present invention will become apparent from the following detailed description, the accompanying drawings, and the appended claims.

DETAILED DESCRIPTION OF THE INVENTION

Figure 1:
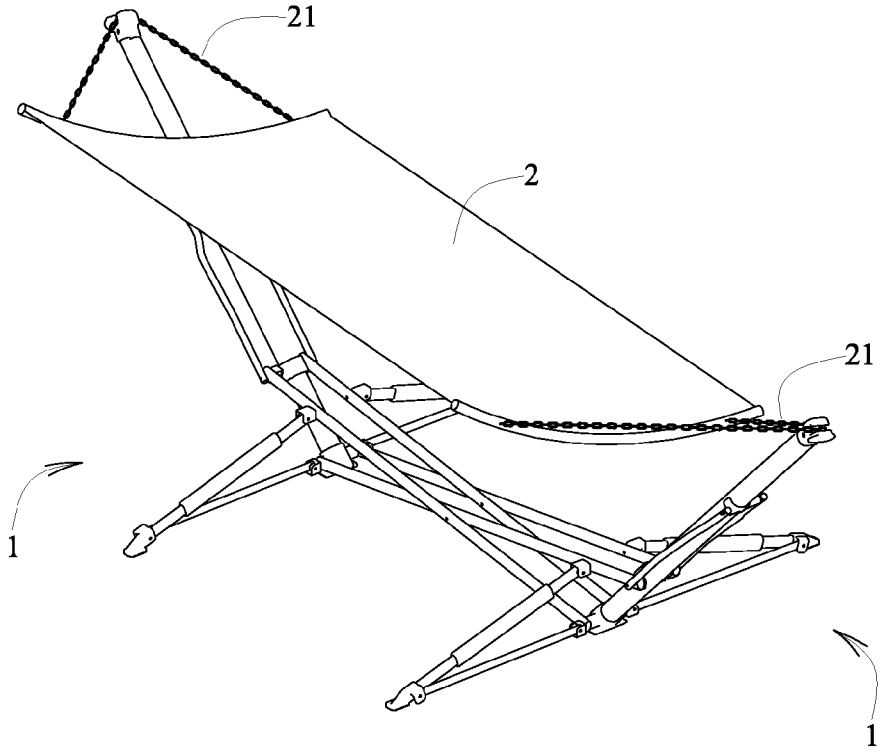
FIG. 1 is a perspective view showing a preferred embodiment of the foldable hanging bed of the invention.

With reference to FIG. 1, a perspective view of the preferred embodiment of a light and credible foldable hanging bed of the invention is shown. The hanging foldable bed is in a status of being expanded. The foldable bed has a frame 1 and a bed fabric 2 detachably hanged to the frame 1 by a hanging chain 21 securely fixed to the fabric 2. The bed fabric 2 is foldably soft and so strong as being able to act as a bedplate when the foldable bed is expanded.

Figure 2:
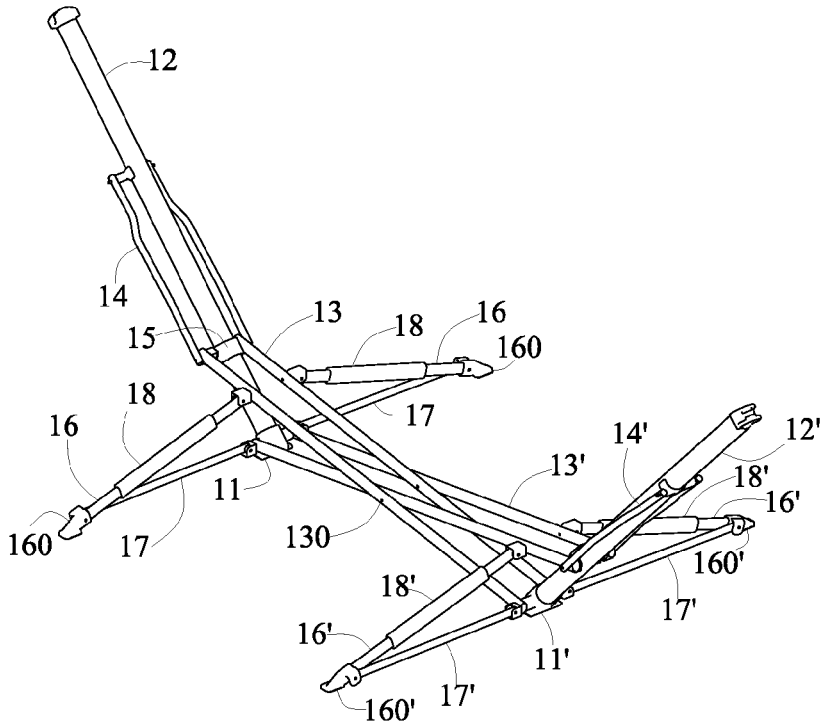
FIG. 2 is a schematic perspective view showing the foldable hanging bed shown in FIG. 1 with a bed fabric thereof being removed.

As particularly shown in FIG. 2, the frame 1 has a first seat 11 and a second seat 11'. A successive first supporting arm 12 and a successive second supporting arm 12' are pivotally linked to the first seat 11 and the second seat 11', respectively. A first lower linking pole 13 has an upper end and a lower end pivotally linking to the second seat 11', and a second lower linking pole 13' has an upper end and a lower end pivotally linking to the first seat 11; the first lower linking pole 13 and the second lower linking pole 13' are cross junctured by a middle pin 130 and able to rotate with each other. A first upper linking pole 14 has two ends pivotally linked to the first supporting arm 12 and the upper end of the first lower linking pole 13, respectively; a second upper linking pole 14' has two ends pivotally linked to the second supporting arm 12' and the upper end of the second lower linking pole 13', respectively. Together with reference to FIG. 3, a stopping element 15 or 15' is provided at each point where the first upper linking pole 14 pivotally links to the first lower linking pole 13 or the second upper linking pole 14' pivotally links to the second lower linking pole 13'. A pair of first side support tubes 16 are pivoted to the first lower linking pole 13, respectively. A pair of second side support tubes 16' are pivoted to the second lower linking pole 13', respectively. A lower end of each side support tube 16 or 16' is provided with a shoe 160 or 160'. A first connecting tube 17 is provided pivotally linking one shoe

160 on each first side support tube 16 and the first seat 11. A second connecting tube 17' is provided pivotally linking one shoe 160' on each second side support tube 16' and the second seat 11'. A sponge sleeve 18 or 18' may be provided covering on each side support tube 16 or 16' for convenience of holding by hands of a user.

Figure 3:
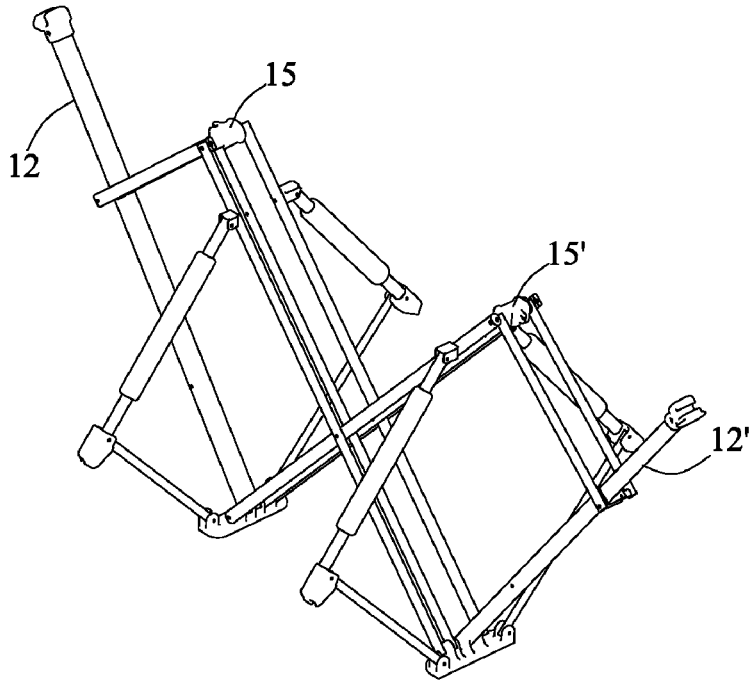
FIGS. 3 through 4 are schematic views showing an operation of folding of the foldable hanging bed shown in FIG. 2.
Figure 4:
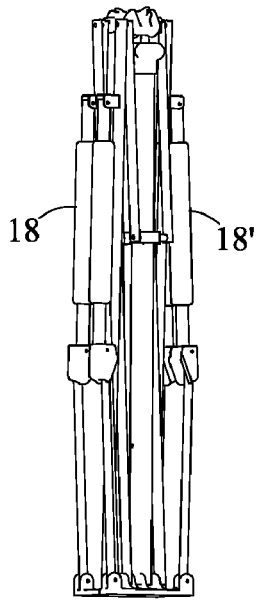

An operation of folding the foldable hanging bed of the invention is as shown in FIGS. 1 through 4. The user is able to detach the fabric 2, as shown in FIG. 1, from the frame 1, leaving the expanded frame 2 as shown in FIG. 2. Then the user is able to hold with both hands the sponge sleeves 18 and 18' on the side support tubes 16 and 16' at one side of the bed, and push forcibly inward. As shown in FIG. 3, the stopping elements 15 and 15' then will move upward and leave the first and the second supporting arms 12 and 12', respectively. Keeping pushing the sponge sleeves 18 and 18', the frame 2 will collapse into a folded position as shown in FIG. 4. The bed then is able to be put into a bag for carrying. A contrary operation may expand the foldable bed of the invention for use.

From above description, it could be seen that with the successive first and second supporting arms 12 and 12', the joint and check element are saved and the risk of break of the joint is diminished and a weight will be able to lowered.

Figure 5:
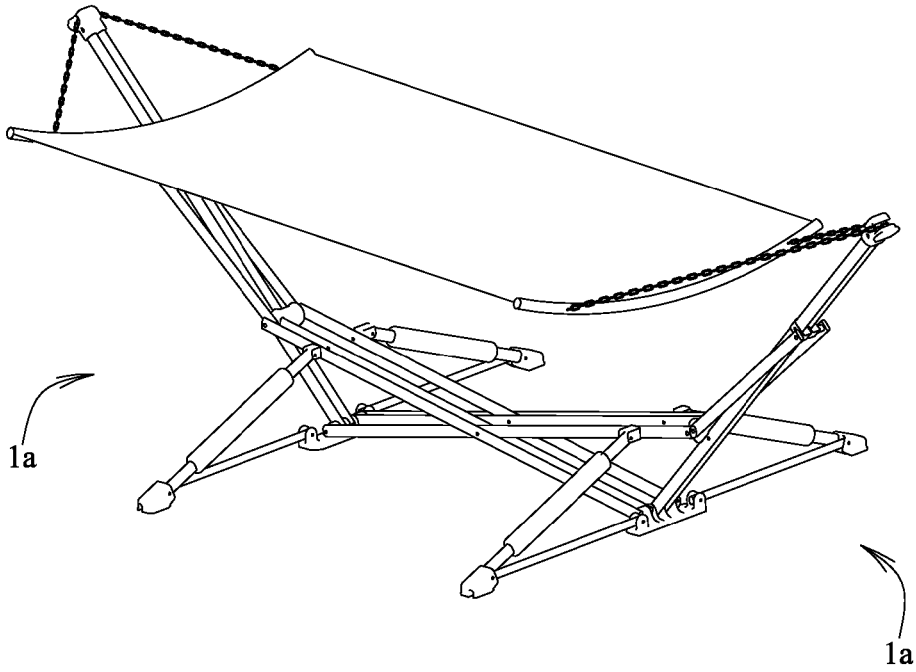
FIG. 5 is a perspective view showing another preferred embodiment of the foldable hanging bed of the invention. And, FIG. 6 is a schematic perspective view showing the foldable hanging bed shown in FIG. 5 with a bed fabric thereof being removed.
Figure 6:
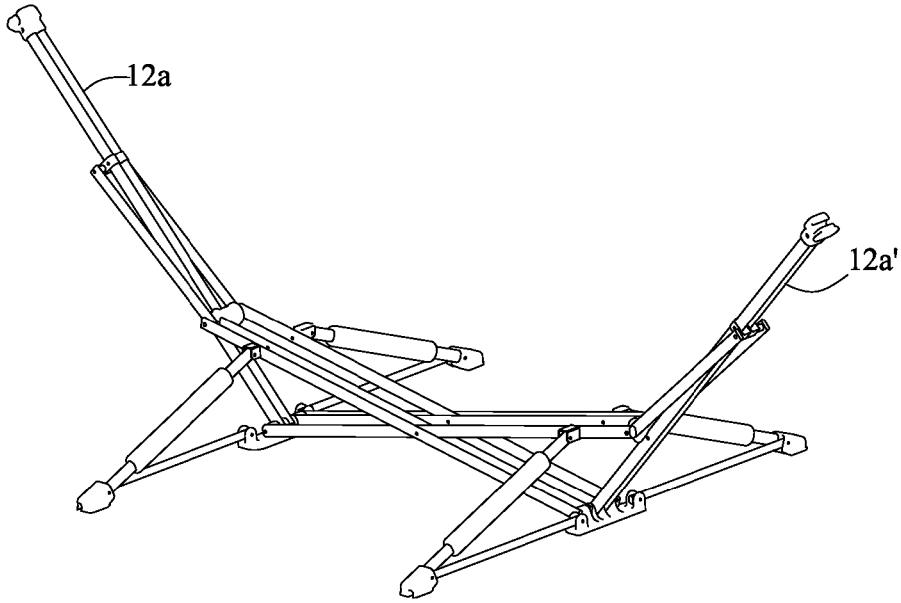

Shown in FIG. 5 is another preferred embodiment of a light and credible foldable hanging bed of the invention is shown. The hanging foldable bed is in a status of being expanded. The foldable bed has a frame 1*a* which having a successive first supporting arm 12*a* and a successive second supporting arm 12*a'*. Each of the first supporting arm 12*a* and an the second supporting arm 12*a'* consists of two identical tubes 121*a* or 121*a'*.

From above description, it is seen that the objects of the present invention have been fully and effectively accomplished. Embodiment of the invention has been shown and described for the purposes of illustrating the functional and structural principles of the present invention and is subject to change without departure from the invention's principles. Therefore, this invention includes all modifications encompassed within the spirit and scope of the following claims.

The invention claimed is:

1. A light and credible foldable hanging bed comprising:

a frame having:

a first seat and a second seat;

a successive first supporting arm and a successive second supporting arm pivotally linked to said first seat and said second seat, respectively;

a first lower linking pole having an upper end and a lower end pivotally linking to said second seat;

a second lower linking pole having an upper end and a lower end pivotally linking to said first seat, with said first lower linking pole and said second lower linking pole being cross junctured by a middle pin;

a first upper linking pole having two ends pivotally linked to said first supporting arm and said upper end of said first lower linking pole, respectively;

a second upper linking pole having two ends pivotally linked to said second supporting arm and said upper end of said second lower linking pole, respectively;

a stopping element provided at each point where said first upper linking pole pivotally links to said first lower linking pole and said second upper linking pole pivotally links to said second lower linking pole;

a pair of first side support tubes pivoted to said first lower linking pole, respectively;

a pair of second side support tubes pivoted to said second lower linking pole, respectively;

a shoe provided at a lower end of each said side support tube;

a first connecting tube pivotally linking one said shoe on each said first side support tube and said first seat;

a second connecting tube pivotally linking one said shoe on each said second side support tube and said second seat; and, a bed fabric attached to said frame.

2. The light and credible foldable hanging bed as claimed in claim 1, wherein a sponge sleeve is provided covering on each said side support tube.

* * * * *